US008074800B2

(12) United States Patent
Hardy

(10) Patent No.: US 8,074,800 B2
(45) Date of Patent: Dec. 13, 2011

(54) LINEAR LAMP CELL PACK

(75) Inventor: Gregory J Hardy, North Andover, MA (US)

(73) Assignee: Osram Sylvania Inc., Danvers, MA (US)

( * ) Notice: Subject to any disclaimer, the term of this patent is extended or adjusted under 35 U.S.C. 154(b) by 131 days.

(21) Appl. No.: 12/410,979

(22) Filed: Mar. 25, 2009

(65) Prior Publication Data

US 2010/0243512 A1 Sep. 30, 2010

(51) Int. Cl.
*B65D 85/42* (2006.01)
*B65D 1/36* (2006.01)

(52) U.S. Cl. ..... 206/419; 206/563; 206/589; 206/443

(58) Field of Classification Search ..... 206/418–422, 206/443, 446, 486, 503, 505, 507, 509, 515, 206/519, 561, 564, 563, 589, 391, 518, 562
See application file for complete search history.

(56) References Cited

U.S. PATENT DOCUMENTS

| | | | | | |
|---|---|---|---|---|---|
| 2,823,828 | A | * | 2/1958 | Frater | 206/507 |
| 3,027,045 | A | | 3/1962 | Wilson | |
| 3,163,312 | A | * | 12/1964 | Chaplin | 217/26.5 |
| 3,223,234 | A | * | 12/1965 | Weiss | 206/419 |
| 3,372,812 | A | * | 3/1968 | Parcels | 211/59.4 |
| 3,608,706 | A | * | 9/1971 | Vigue | 206/422 |
| 3,934,724 | A | | 1/1976 | Johnson | |
| 3,958,711 | A | | 5/1976 | Morris et al. | |
| 4,101,049 | A | * | 7/1978 | Wallace et al. | 206/521.1 |
| 4,195,743 | A | * | 4/1980 | Emery | 217/26.5 |
| 4,320,837 | A | | 3/1982 | Carroll et al. | |
| 4,441,615 | A | | 4/1984 | Goodrich | |
| 4,522,301 | A | * | 6/1985 | Ajmera | 206/507 |
| 4,579,489 | A | | 4/1986 | Sarantitis | |
| 4,711,356 | A | * | 12/1987 | Dunden | 206/503 |
| 4,792,045 | A | * | 12/1988 | Creaden | 206/419 |
| 4,942,965 | A | | 7/1990 | Comer | |
| 5,016,751 | A | | 5/1991 | Creaden | |
| 5,344,021 | A | | 9/1994 | Rose | |
| 5,394,986 | A | * | 3/1995 | Oya et al. | 206/445 |
| 6,041,933 | A | * | 3/2000 | Baker | 206/564 |
| 6,474,473 | B2 | * | 11/2002 | Wong | 206/590 |
| 6,705,469 | B2 | * | 3/2004 | Slot | 206/587 |
| 7,320,405 | B2 | | 1/2008 | Stahl | |
| 2003/0070951 | A1 | * | 4/2003 | Hurley et al. | 206/427 |

* cited by examiner

*Primary Examiner* — Steven A. Reynolds
(74) *Attorney, Agent, or Firm* — Edward Podszus; Robert F. Clark; Andrew Martin

(57) ABSTRACT

A tray for supporting linear lamps in large cartons may be made to nest in one orientation and on rotation by 180 degrees may stack to form a latched array of lamp cradles. The cradle walls are formed along their lengths with alternating lengths and gaps. The alternating wall sections of the cradle walls are asymmetric right to left along the cradle axis. The walls forming the rows of cradles are arranged to be paired with a non-nesting wall on rotation by 180 degrees. In this way, at least one point along the length of each wall is supported in the non-nesting orientation. By forming latching features at the support points, the trays can be locked together as a rigid array of lamp cradles.

20 Claims, 3 Drawing Sheets

LINEAR LAMP CELL PACK

CROSS-REFERENCE TO RELATED APPLICATIONS

Not applicable

BACKGROUND OF THE INVENTION

1. Field of the Invention

The invention relates to packaging for electric lamps and particularly to tubular electric lamps. More particularly the invention is concerned with a packing tray for tubular lamps.

2. Description of the Related Art Including Information Disclosed Under 37 CFR 1.97 and 1.98

Fluorescent lamps are commonly stacked and then shipped in an outer case. The lamps are divided and cushioned one from another so they do not crash into each other during shipping. On arrival the outer carton is frequently placed on an open shelf and used as a dispenser. As lamps are selected they are removed from the outer carton. As more lamps are removed the separating materials, which in the past have been pulpwood tray dividers, soft packing materials such as single-face wrappers, and other cushioning materials, either pull out with the lamps or become disorganized and free to move making it difficult to reload the case for display, storage or recycling purposes. There is then a need for a packing structure that continues to function despite the number of lamps removed from the outer carton. At the same time, the packing material must be able to be nested in condensed forms to efficiently ship and store them before and after they are used to ship the fluorescent lamp products. It is expensive to ship, hold and recycle bulky packing materials. There is then a need for a packing structure that is easily condensed for original shipping and storing, and also for return.

BRIEF SUMMARY OF THE INVENTION

A packing tray to cradle a linear lamp may be formed so that in one orientation the trays may be substantially nested one into the next to enable close packing. In a second orientation, one tray may be rotated 180 degrees with respect to a second tray, whereby the trays do not nest, but form a coupled assembly of trays. The stacked trays form an array of cradles for linear lamps. A molded sheet of plastic resin with a first side and a second side defines a stacking axis extending from the first side to the second side. The first side of the tray is formed with projections defining horizontal cradles to hold side portions of linear lamps. The second side of the tray is formed with recesses symmetrically corresponding to the projections, whereby a first side of a first tray may be substantially nested into a second side of a similarly formed second tray when the trays are similarly oriented. However, some or all of the projections and the corresponding recesses are not symmetrically formed with respect to a 180 degree rotation around the stacking axis. As a result, the first side of a first tray does not nest with respect to the second side of a rotated second tray. In the anti-nesting orientation, two trays join as a stacked assembly.

DETAILED DESCRIPTION OF THE INVENTION

Figure 1:
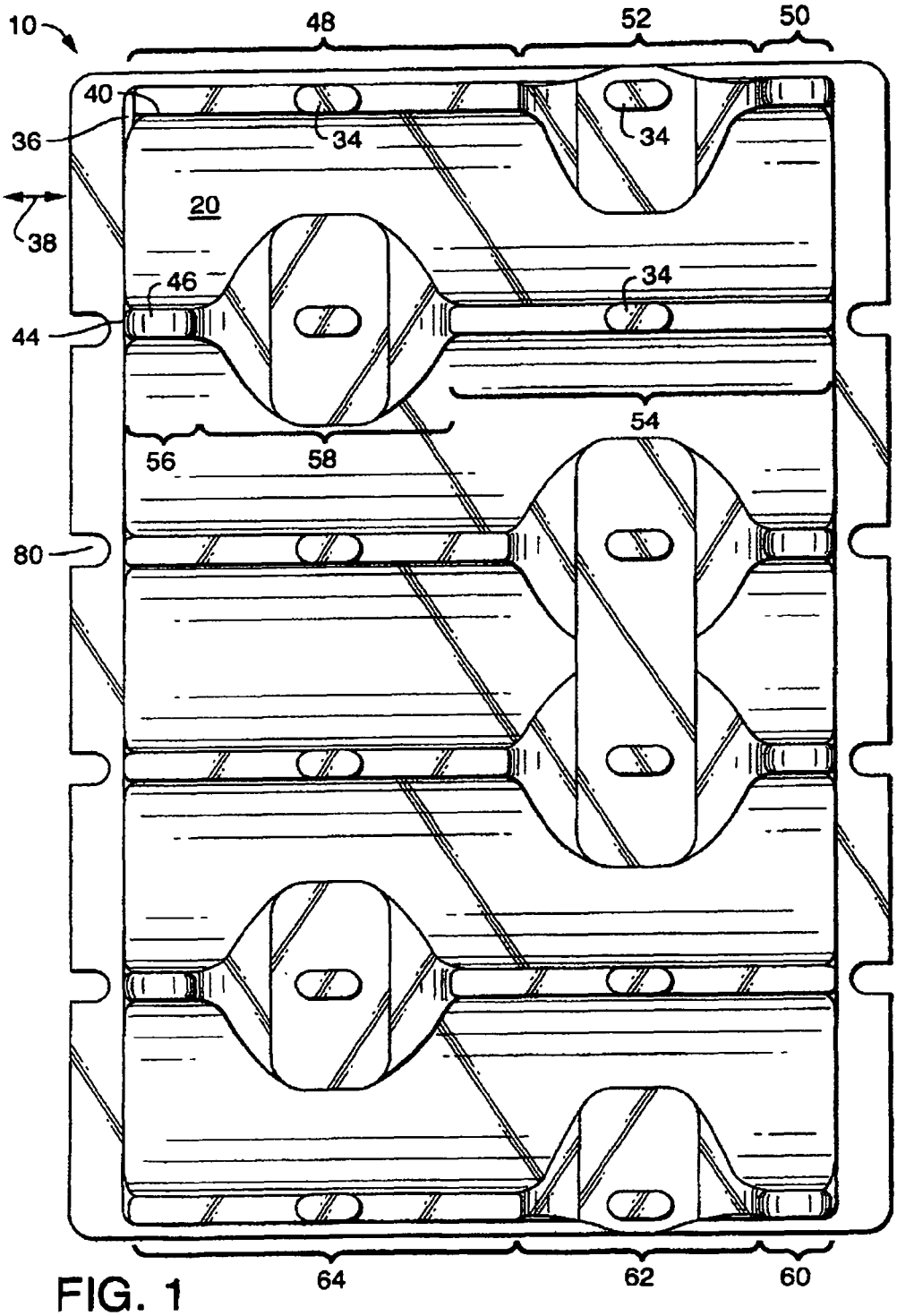
FIG. 1 shows a top view of a preferred embodiment of a packing tray for a linear lamp.
Figure 2:
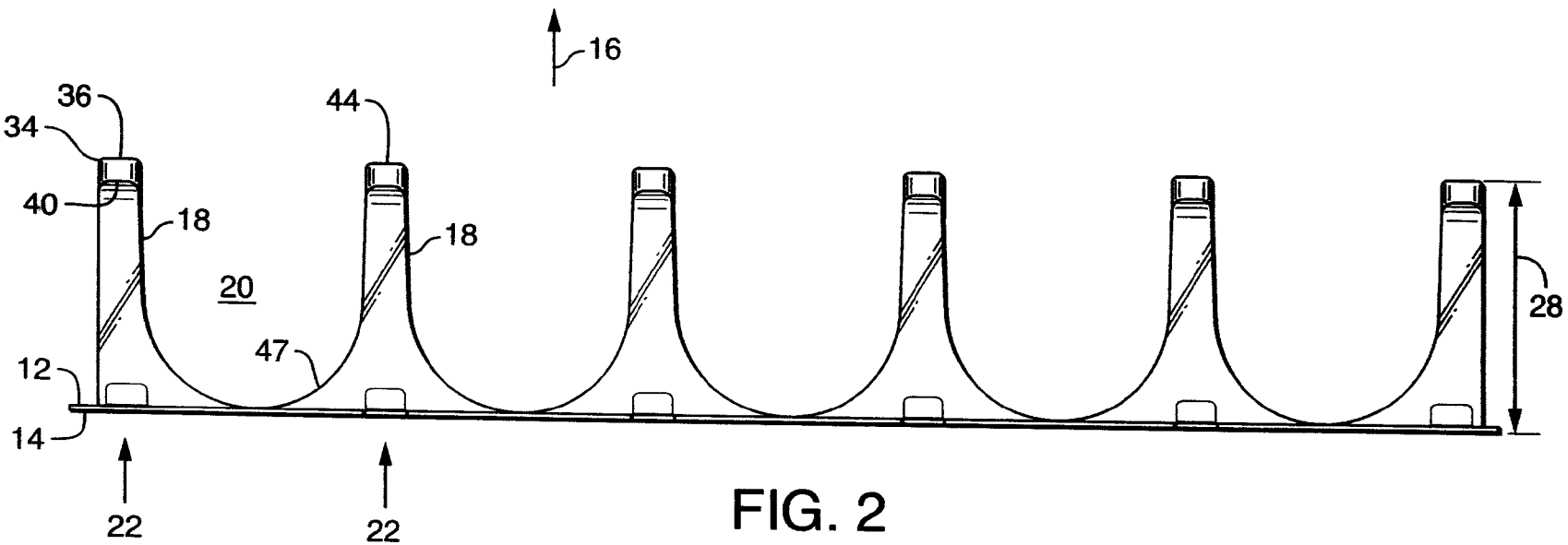
FIG. 2 shows a side view of a preferred embodiment of the packing tray in FIG. 1.

FIG. 1 shows a top view of a preferred embodiment of a linear fluorescent lamp packing tray 10. FIG. 2 shows a side view of a preferred embodiment of the packing tray in FIG. 1. The preferred packing tray 10 is formed as a single piece from a molded sheet of plastic resin. The preferred resin is formable by thermal or vacuum molding, such as PET, RPET, PETG, HiPS and others. The sheet has a first side 12 and a second side 14, with a defined stacking axis 16 extending perpendicularly from the first side 12 to the second side 14. The first side 12 is formed with projections 18 defining at least one horizontal cradle 20 to fit closely with and hold a side of a linear lamp, such as a four foot T-12 fluorescent lamp tube. In the preferred embodiment a convenient number of cradles 20 are formed side by side, for example 5 or 6 cradles, so that groups of lamps may be conveniently arrayed in multiples of 5 or 6. The second side 14 is formed with recesses 22 that are symmetrically positioned to correspond to the projections 18 on the first side 12. Practically, when a single sheet of resin is molded the recesses 22 molded into the second side 14 appear as projections 18 on the first side 12. The projections 18 and recesses 22 then have substantially similar sizes, shapes and positions. As a result, a first side 12 of a first tray 30 may be substantially nested into a second side 14 of a similarly formed second tray 32 when similarly oriented. The respective projections 18 then slide into the corresponding recesses 22.

Figure 3:
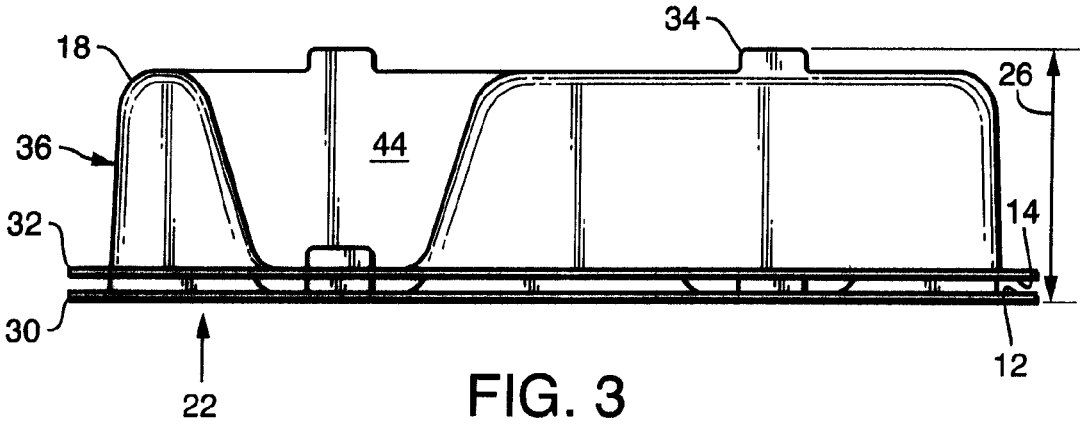
FIG. 3 shows end views of two of the packing trays in FIG. 1 oriented for nesting.
Figure 4:
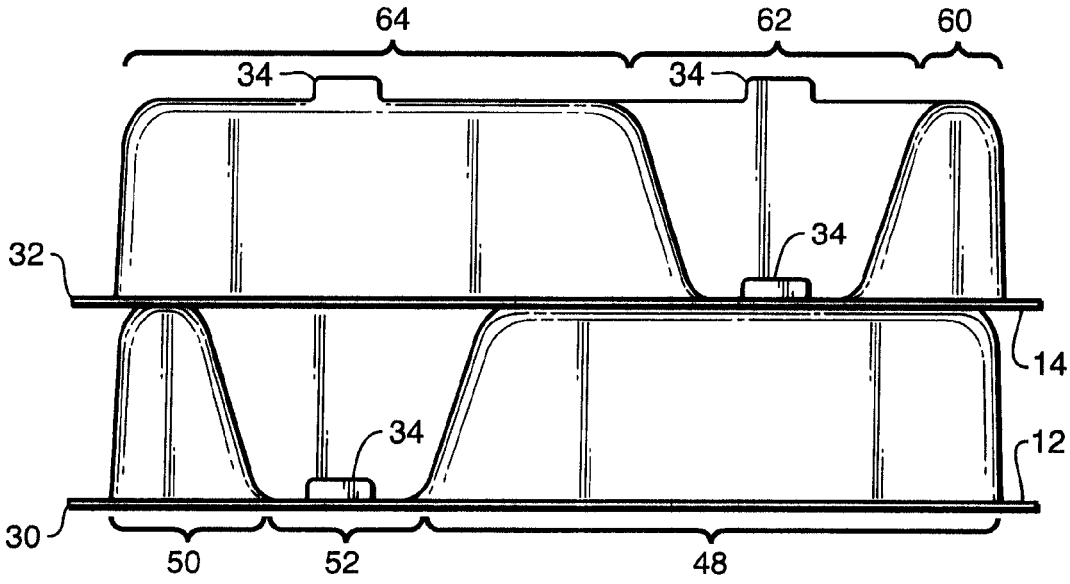
FIG. 4 shows end views of two of the packing trays in FIG. 1 oriented for stacking

FIG. 3 shows end views of two of the packing trays in FIG. 1 oriented for nesting. The two trays 30, 32 can be substantially nested when the trays are stacked one on top of the other to have a combined height 26 less than twice the individual tray height 28. In practice, trays 30, 32 can be formed such that two nested trays 30, 32 stacked to have a combined height 26 of little more than the height 28 of one tray 10 plus the height of the sheet thicknesses, and a small air gap. The projections 18 are also formed so that some or all of the projections 18 and the corresponding recesses 22 are not symmetrically formed with respect to a 180 degree rotation of the tray 10 around the axis 16. As a result of the asymmetry, the first side 12 of the first tray 30, unrotated does not nest with the second side 14 of a rotated second tray 32. Rather, there are two or more interference points that prohibit nesting of the first tray 30 with the second tray 32 in the anti-nesting, 180 degree rotated orientation. If the interference points are judiciously placed, the stacked trays are stabile. As seen in FIG. 4 a second side 14 of tray 32 may be stacked on a first side 12 of a similarly formed second tray 30 when rotated 180 degrees around the axis 16 so that the two trays 30, 32 do not nest. The trays 30, 32 may however include nesting latches 34 formed at the interference points. In the anti-nesting orientation, two trays 30, 32 then stack without nesting, forming an assembly defining a lamp holder to align and array linear fluorescent lamps.

The first side 12 has a first wall 36 extending in a cradle axial direction 38, and a second wall 44, also extending in the cradle axial direction 38. The first wall 36, at least at the top 40 of the first wall 36 is offset from the second wall 44, at least at the top 46 of the second wall 44 by at least the diameter of the lamp to be cradled. In the preferred embodiment, the respective side walls 36, 44 form the respective lamp cradles 20. The cradle facing portions of the side wall 36, 44 may be curved or otherwise shaped to form a semi cylindrical base portion 47, or similar shapes to conform to at least a portion of the lamp exterior. The two side walls 36, 44 then define a cradle 20 to receive and snuggle or cradle the exterior side of a linear fluorescent lamp, typically cylindrical. Square or angled walls could be used but are considered to have less of a cradling form, although they may be appropriate for such a shaped lamp.

The first wall 36 is segmented along its length into at least a first upstanding portion 48 and a second upstanding portion 50. The first upstanding portion 48 and the second upstanding portion 50 are separated or divided along the length of the first wall 30 by a notch region 52. In the preferred embodiment, the first upstanding portion 48 and the second upstanding portion 50 have differing lengths and are therefore asymmetrically with respect to a 180 degree rotation of the tray. The second wall 44 portion may be similarly formed with a first upstanding portion 54 and a second upstanding portion 56. The first portion 54 and the second portion 56 of the second wall 44 also being divided by a notch region 58. In the preferred embodiment portions 48, 50, and 52 are similar to portions 54, 56 and 58 but are reversed in order along the cradle axis 38.

The second side 14 of the sheet 12 is formed in a region that extends parallel to the first wall 36 with a first recess that extends into the first upstanding portion 48. Similarly a formed second recess extends into the second upstanding portion 50. The second side 14 is further formed along a region that extends parallel to the second wall 44 with a similar first recess that extends into the first upstanding portion 54 of the second wall 44 and a second recess that extends into the second upstanding portion 56 of the second wall 44. The respective side walls and recesses are sized and shaped so that when similarly oriented, the recesses of a second tray 32 may receive on insertion the corresponding respective upstanding portions of a first tray 30. The respective walls of first tray 30 may then be inserted into the respective recesses of the second tray 32, to closely nest the respective trays 30, 32.

In the preferred embodiment, the interfering contact points, those regions interfere with insertion when the first tray 30 is rotated 180 degrees with respect to the second tray 10 are formed with latching elements to enable the first tray 30 and the second tray 32 to snap together, to be aligned or otherwise guided and retained in place one tray to the other tray by corresponding latching features 34. In the preferred embodiment the relatively longer wall sections 48, 54 overlap the respective notch regions 52, 58 on rotation. The latch points 34 are then stationed along the wall section 48 and the notch region 52 at equal distances from the sides of the tray so the match on rotation. The top of the wall section 48 then provides an interference point with respect to the notch region 52. At these interference points, the Applicant forms indented wall portions having an oval form extending parallel to the stacking axis 16. In the anti-nested orientation, the first tray 30 and the second tray 32 can mate the two latching regions by inserting one oval projection 34 into the parallel and similarly aligned oval recess in the adjacent second tray. The first tray 30 then snaps into alignment with the second tray 32. Alternating rows (1, 3, 5 . . . ) may then be aligned for support and latched coupling on say the left side, and the remaining alternate rows (2, 4, 6 . . . ) may be similarly aligned for support and latched coupling on say the right side. Mirror imaging at the middle of the tray may be needed if there is an odd number of cradles, that is, an even number of walls. The coupled trays then form a rigid assembly of layered trays defining a grid like array of slots (cradles) to receive and retain linear lamps.

In the preferred embodiment the second wall 44 portion of the first wall 36 includes an upstanding (protruding) oval shaped protrusion e.g. 34, and the notch regions 58 of the second wall 44 include a similar indentation sized and situated to receive the upstanding oval protrusion (insert) into and be snap fitted with the corresponding element on the second wall 44 portion. Two adjacent trays 30, 32 in the anti-nesting orientation then prohibit substantial nesting of one with regard to the other, but enable a minor nesting of the latch elements 34 to lock the trays 30, 32 together.

FIG. 3 shows an end view of two linear lamp packing trays 30, 32 oriented for nesting on with the other. In the nesting orientation, the respective projections portions of the side walls of a first tray 30 slide into the corresponding recess portions of the second tray 32. The stacking height 26 of the two trays may then be substantially reduced, thereby making initial shipping, and subsequent reshipping, for example for recycling, easier. In the limit the stacking height 26 can be reduced to the overall height of a single tray 28, plus the sheet thickness of a tray times the number of trays stacked on the first tray. Unused trays may be conveniently stored and shipped in the space saving or compact nested form.

FIG. 4 shows end views of two stacked trays 30, 32 oriented for stacking. The end of the lower tray 30 shown in FIG. 4, is the same as the upper end of the tray in FIG. 1. However, the lower tray 30 in FIG. 4 shows a 180 degree rotation from FIG. 1, with the numbering in reverse order. In the lower tray 30 (first row), following from left to right, the first wall 36 includes a first relatively wide projection 48 including a latch portion 34 formed along the top wall of the wide projection 48, followed by a notch region 52 that includes a latch portion 34 formed along the floor of the notch 52. Next follows a relatively narrow projection 50. Seen behind the first wall 36 is the second wall 44 of the lower tray 30. The first wall 36 and the second wall 44 defining cradle region 20.

The end of the upper tray 32 shown in FIG. 4, is the same as the lower end of the tray in FIG. 1. The upper tray 32 in FIG. 4 is not rotated from FIG. 1, and the numbering is in the same order. Looking to the upper tray 32, the first wall, also has a similar narrow projection 60, notch region 62 and wide projection 64 (right to left). The notch region 62 of the upper tray 32 rests on the top of the wide projection 48 of the lower tray 30. The two trays 30, 32 are latched together by the nesting the corresponding latching portions one inside the other. The second wall of the upper tray is similar to the first wall of the lower tray 30. In this way the alternating end portions of the trays are braced one against the other. The first wall is braced (latched) on the right side; the second wall is braced on the left side and so on.

In the preferred embodiment the top portion of the first wall portion includes a latch element such as a protuberance, and formed on the underside of the corresponding notch portion is a similarly formed recess, such that the top side projection may be inserted into the recess formed on the notch portion. In this way the second tray 32 may be locked onto the first tray 30. The second tray 32 cannot then slide right or left (in the cradle axis 38 direction) or in or out of the plane of the page (perpendicular to the stacking axis and to the cradle axis.) Lamps may then be slid into the cradles (slots) formed between the side walls without the trays separating, or drifting with respect to each other. The stacked trays then form a mutually latched, reinforcing structure. The preferred trays are designed to support only portions of the lamps. So for example, one tray was about 17 centimeters long and 25 centimeter wide. The tray was made of clear PET and had a thickness of 0.635 millimeters (0.025 mil). A further developed tray is made of black PET with a thickness of 0.635 millimeters (0.025 mil). Randomly mixed or recycled material is expected to be the least expensive. Color is not considered to be important. Each cradle was about 4.0 centimeters across. One tray set is used at one end of a large carton, and a second tray set is used at the opposite end of the large carton supporting 4 foot lamps at each end. Of course one or more tray sets may be used intermediate the end tray sets. For example, for a 4 foot T-12 lamp carton, may have two end sets of trays and optionally one middle set of trays, and for example may be used to hold 20 (4×5), 24 (4×6), 30 (5×6) or 36 (6×6) lamps. The trays may include a side notched 80 or similar latch feature along an outer edge to latch with the outer carton separator or corrugated pad to hold the tray array in place with respect to the outer carton.

In the preferred embodiment, with a first example of the tray rotated 180 degrees with respect to a similar second example of the tray, there are formed interference points defined by regions of the tray blocking complete nested insertion of the first example of the tray into the second example of the tray. The applicant locates a portion of the interference points the latching features that latch the first example of the tray to the second example of the tray in the rotated orientation. In particular, the preferred latching features comprise on one of the trays a steep walled indentation and on a second tray a corresponding steep walled projection. The trays otherwise permit insertion of the steep walled projection into the steep walled indentation, while blocking complete nesting in the rotated orientation. In this way (slightly meshed arrangement) the trays may be latched together. The preferred packing tray has a plurality of formed cradles, and also has at least one latching feature formed adjacent each cradle. In this way each set of walls forming a cradle also provide support and coupling for the array. The preferred packing tray with a plurality of formed cradles, has at least three latching features, the latching features are distributed around the stacked tray to form at least one triangular array of latches coupling adjacent layers of respective first trays with rotated respective second trays. In this way the three or more latch points form vertical support and resist rotational twisting between latched layers of trays. The preferred packing tray has a plurality of cradles each having respective first ends and respective second ends, and at least two latching features adjacent two differing first ends of the cradles and having at least two latching feature adjacent two differing second ends of the cradles. In this way, the right and left sides of the latch array are both supported. A preferred tray enables each stacked pair of latched packing trays to form two or more latched couplings along the first ends of the cradles (right side of a midline) and to form two or more latched couplings along the second ends of the cradles (left side of a midline), and to position two or more latched couplings along a first end of the tray and to form two or more latched couplings along the second end of the tray, the end opposite the first end, thereby distributing the latched points in a quadrilateral format. In this way, the four sides or four corners of the latched arrays of trays are all support.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A packing tray to cradle a linear lamp comprising:

a molded sheet of plastic resin having a first side and a second side defining an axis extending from the first side to the second side, the first side of the tray being formed with projections defining at least one horizontal cradle extending across a width of the packing tray wherein a first projection and a second projection are substantially parallel along the entire length of the first projection and the second projection and provide the cradle with a cross-sectional shape and the cross-sectional shape extends along the entire width of the molded sheet bound by the first projection and the second projection, the second side of the tray being formed with recesses symmetrically corresponding to the projections, whereby a first side of a first tray may be substantially nested into a second side of a similarly formed second tray when similarly oriented, and some or all of the projections and the corresponding recesses are not symmetrically formed with respect to a 180 degree rotation of the tray around the axis, whereby the first side of a first tray may be stacked on a second side of a similarly formed second tray when rotated 180 degrees around the axis without substantial nesting of the first tray into the second tray.

2. The packing tray in claim 1, wherein a first example of the tray is rotated 180 degrees with respect to a similar second example of the tray, interference points are defined by regions of the tray blocking complete nested insertion of the first example of the tray into the second example of the tray, and located at a portion of the interference points are latching features formed to latch the first example of the tray to the second example of the tray in the rotated orientation.

3. The packing tray in claim 2, wherein the latching features comprise on one of the trays a steep walled indentation and on a second of the trays a corresponding steep walled projection, the trays otherwise permitting insertion of the steep walled projection into the steep walled indentation, while blocking complete nesting in the rotated orientation.

4. The packing tray in claim 3, having a plurality of formed cradles, and wherein at least one latching feature is formed adjacent each cradle.

5. The packing tray in claim 3, having a plurality of formed cradles, and having at least three latching features, the latching features being distributed to form at least one triangular array of latches coupling the first tray with the second tray.

6. The packing tray in claim 3, having a plurality of cradles having first ends and respect second ends, having at least two latching features adjacent two differing first ends of the cradles and having at least two latching feature adjacent two differing second ends of the cradles.

7. The packing tray in claim 1, wherein the cradle comprises, as viewed from the width direction, the cross-sectional shape generally intersecting a half-cylinder.

8. The packing tray in claim 7, wherein the cradle comprises a substantially half-cylindrical shape.

9. The packing tray in claim 1, in combination with a linear lamp, forming a lamp packing assembly, wherein the linear lamp is disposed in the cradle, and the cradle comprises a cross-sectional shape generally conforming to a circumferential portion of an outer surface of the linear lamp.

10. The lamp packing assembly in claim 9, further comprising a second said tray, wherein the linear lamp is disposed in the cradle of the first tray underneath the second side of the second tray.

11. The packing tray in claim 1, further comprising a second said tray, forming a stacked tray assembly, wherein the second side of the second tray is stacked in contacting relation to the first side of the first tray.

12. The packing tray in claim 1, wherein a spacing between adjacent projections of said first tray, along a longitudinal direction transverse to said width, corresponds to about 4 centimeters.

13. A packing tray to cradle a linear lamp comprising:

a molded sheet having a first side and a second side;

the first side having a first wall extending in an axial direction having a first height, the first wall defining a cradle extending across a width of the packing tray, a second wall extending in the axial direction and having the same height as the first wall; the first wall being segmented into at least a first upstanding portion and a second upstanding portion, the first upstanding portion and the second upstanding portion being divided by a notch region, the first upstanding portion and the second upstanding portion having the same height, being the height of the wall, and the notch region having a lower height than the wall height; the second wall portion also being similarly segmented into at least a similar first upstanding portion and a similar second upstanding portion, the first upstanding portion and the second upstanding portion also being divided by a similar notch region wherein the first wall and the second wall are substantially parallel and provide the cradle with a cross-sectional shape and the cross-section shape extends along the entire length of the first wall and the second wall;

the second side being formed in a region extending parallel to the first wall with a first recess extending into the first upstanding portion and a second recess extending into the second upstanding portion; the second side being further formed along a region extending parallel to the second wall with a similar first recess extending into the first upstanding portion of the second wall and a second recess extending into the second upstanding portion of the second wall, the respective walls and recesses being sized and shaped so that when similarly oriented the recesses of a first tray may receive on insertion the respective upstanding portions of a second tray by inserted into the respective recesses of the first tray, to closely nest the respective trays; and the respective first wall's first upstanding portion, second upstanding portion and notch region and the second wall's first upstanding portion, second upstanding portion and notch region arranged complimentarily so that at least one notch region along the first wall abuts at least one region along the second wall and at least one region along the first wall abuts at least one notch region along second wall when a first tray is rotated 180 degrees in the plane of the tray.

14. The packing tray in claim 13, wherein the cradle comprises, as viewed from the width direction, the cross-sectional shape generally intersecting a half-cylinder.

15. The packing tray in claim 14, wherein the cradle comprises a substantially half-cylindrical shape.

16. A packing tray to cradle a linear lamp comprising:

a formed sheet having a first side and a second side defining an axis extending from the first side to the second side, the first side of the tray being formed with projections defining at least one horizontal cradle extending across a width of the packing tray wherein a first projection and a second projection are substantially parallel along an entire width of the molded sheet and provide the cradle with a cross-sectional shape defined by the first projection and the second projection and both a first edge and an opposite second edge of the first projection and the second projection have the cross-sectional shape, the second side of the tray being formed with recesses corresponding to the projections, whereby a first side of a first tray may be substantially nested into a second side of a similarly formed second tray when similarly oriented, and some or all of the projections and the corresponding recesses are not symmetrically formed with respect to a 180 degree rotation of the tray around the axis, whereby the first side of a first tray may be stacked on a second side of a similarly formed second tray when rotated 180 degrees around the axis without substantial nesting of the first tray into the second tray.

17. The packing tray in claim 16, wherein the formed sheet comprises a plastics material.

18. The packing tray in claim 16, wherein the formed sheet comprises a thermoformed material.

19. The packing tray in claim 16, wherein the cradle comprises, as viewed from the width direction, the cross-sectional shape generally intersecting a half-cylinder.

20. The packing tray in claim 19, wherein the cradle comprises a substantially half-cylindrical shape.

* * * * *